US009174327B1

(12) United States Patent
Christensen

(10) Patent No.: US 9,174,327 B1
(45) Date of Patent: Nov. 3, 2015

(54) SOCKET ASSEMBLY

(71) Applicant: Arthur E Christensen, Towson, MD (US)

(72) Inventor: Arthur E Christensen, Towson, MD (US)

( * ) Notice: Subject to any disclaimer, the term of this patent is extended or adjusted under 35 U.S.C. 154(b) by 0 days.

(21) Appl. No.: 14/535,870

(22) Filed: Nov. 7, 2014

(51) Int. Cl.
*B25B 13/28* (2006.01)
*B25B 13/06* (2006.01)
*B25B 23/00* (2006.01)

(52) U.S. Cl.
CPC ..... *B25B 13/28* (2013.01); *B25B 13/065* (2013.01); *B25B 23/0007* (2013.01)

(58) Field of Classification Search
CPC ..... B25B 13/06; B25B 13/065; B25B 13/28; B25B 13/44; B25B 23/00; B25B 23/0007
USPC ..... 81/53.2, 111, 125, 185, 90.1, 90.2
See application file for complete search history.

(56) References Cited

U.S. PATENT DOCUMENTS 2,956,462 A 10/1960 Paul
3,527,327 A * 9/1970 McCreary ..... 81/90.2
3,664,213 A * 5/1972 Anati ..... 81/90.2
4,416,173 A 11/1983 Rebish
4,611,513 A * 9/1986 Young et al. ..... 81/53.2
4,724,730 A 2/1988 Mader et al.
5,282,830 A * 2/1994 Reynolds ..... 81/90.1
5,544,555 A 8/1996 Corley et al.
5,791,209 A 8/1998 Marks
5,918,511 A 7/1999 Sabbaghian et al.
7,290,467 B2 11/2007 Harker
7,707,916 B2 5/2010 Pirseyedi
2003/0110903 A1 6/2003 Creek
2007/0227311 A1 * 10/2007 Wang ..... 81/125

* cited by examiner

*Primary Examiner* — Hadi Shakeri
(74) *Attorney, Agent, or Firm* — August Law, LLC; George Willinghan

(57) ABSTRACT

A socket assembly includes a plurality of multi-faceted segments disposed in a standard multi-point socket in an annular arrangement, one multi-faceted segment for each apex in the multi-point socket. Each multi-faceted segment has a length extending between two ends and a plurality of flat facets extending along the length including two outer facets defining a pivot edge that engages an apex between two internal socket walls and an internal facet facing inwardly and sized to engage a side of a multi-sided fastener. A retaining mechanism is provided to secure the plurality of multi-faceted segments in the standard multi-point socket.

20 Claims, 9 Drawing Sheets

SOCKET ASSEMBLY

FIELD OF THE INVENTION

The present invention relates to sockets used with socket wrenches.

BACKGROUND OF THE INVENTION

Socket wrenches typically include a plurality of sockets that are interchangeably attached to a wrench arm, for example, a ratchet arm. The plurality of sockets cover a range of standard and metric sizes and includes socket point shapes such as square, hexagon, octagon and double hexagon or dodecagon. The sizing fit between the socket size and the fastener, e.g., bolt, to be tightened or loosened is important, as stripping or rounding of the bolt head can result from a sizing mismatch. In addition, conventional sockets apply pressure on the corners of the bolt head. For bolt heads manufactured from softer metals, this enhances the risk or stripping or rounding. For painted bolts, epoxy coated bolts and chromed bolts, pressure applied to the corners of the bolts results in chipping or removal of the paints or coatings. As these paints and coatings are important for corrosion prevention, the chipped portions must be fixed by touching up the chipped portions in-situ after the bolt has been installed and tightened. This is a labor intensive process that is exasperated for applications where large numbers of fasteners are used and the fasteners are located in remote locations, e.g., bridges and towers.

Attempts to provide improved contact between a socket and the head of a bolt include using a cam mechanism that attempts to grasp or contact the individual faces of the head of a bolt. These mechanisms translate the rotational motion of the socket and the torque applied by the wrench arm to radial forces impacting on the faces of the head of a bolt. In general, these cam mechanism sockets include custom arrangements of sockets with custom internal parts. This requires an entire new set of sockets. In addition, the arrangement and interaction of the internal parts can be complicated, increasing costs and he potential for mechanical wear and failure. These cam arrangement mechanisms still only contact a portion of each face of a bolt head and apply lateral forces to the each face, i.e., forces along the face of the bolt. Lateral forces and partial contact, which permits movement of each face relative to a point of contact, still present the risk of chipping or removing a coating or engaging the corners of the head of a bolt.

Other attempts use inserts placed in existing sockets. These attempts include inserting magnets to hold a bolt for positioning and installation. In addition, the inserts form a more rounded profile to the interior of the socket to compensate for a bolt head that is stripped or rounded. Inserts include elastomeric components that grip and hold or cushion the head of the bolt. However, these elastomers will also deform under applied forces and will loose elasticity over time. In addition, these inserts do not utilize cam mechanisms that translate the rotational forces to radially forces. Therefore, devices are desired that provide for improved contact between a socket and a bolt head and that eliminate the risk of damage to coatings applied to the bolt head.

SUMMARY OF THE INVENTION

Exemplary embodiments of systems and methods in accordance with the present invention are directed to socket assemblies that provide for improved contact with the sides of a multi-sided fastener such as a bolt or nut to tighten or loosen the fastener. Contact with the fastener corners between adjacent sides is avoided, which avoids stripping and rounding of the fastener and chipping or removal of paint or coatings that have been applied to the fastener. The socket assemblies cover a range of socket sizes and socket point shapes for both standard and metric sized fasteners. The present invention can be provided as a standard socket that has been modified to include the additional structures that provide the improved contact with the sides of the fastener upon rotation of the socket by a socket wrench. Alternatively, the socket assembly is arranged as an insert that is either fixedly or removably attached to a standard socket. The socket insert includes the additional structures that provide the improved contact with the sides of the fastener upon rotation of the socket by a socket wrench.

In one embodiment, the socket assembly, either the complete socket or the socket insert includes a plurality of separate and identical multi-faceted segments. In one embodiment, each segment includes five facets running the longitudinal length of the segment. Preferably, each facet is a flat surface. Each segment has a pivot edge defined between two facets. This pivot edge engages in an apex of a standard socket between two inner socket walls. The facets include a first outer facet and a second outer facet that face adjacent inner socket walls on either side of a given apex. These first and second outer faces meet along the pivot edge. Each segment is free to pivot in a given apex of the socket about the pivot edge. Therefore, the first and second outer faces meet at an angle less than the angle of the apex between the two adjacent inner socket walls. In one embodiment, the first and second outer facets meet at an angle of about 90°.

Each segment also includes an inner facet that is positioned inward to engage a side of a fastener. The inner facet has a width that is substantially the same of the width of the side of the fastener. Therefore, the inner facet contacts substantially an entire width of a given side of the fastener. In one embodiment, each inner facet is polished, for example through a tumbling operation, to remove burs or other marks and protrusions that could scrape the side of the fastener or prevent solid contact between the inner facet and the side of the fastener. A first side facet extends between the first outer facet and the inner facet, and a second side facet extends between the second outer facet and the inner facet. In one embodiment, the first and second side facets contact the inner facet at an angle of about 90°. The first and second side surfaces of adjacent segments face each other, and when the segments pivot about their edges in the apexes, the first and second side surfaces of adjacent segments do not contact each other. This allows the inner fact to make intimate contact with the side of the fastener.

Each segment fits within an existing standard socket and has a longitudinal length equal to or less than the depth of the socket along the inner socket walls. In one embodiment, each segment has a longitudinal length that is approximately 0.03 inches less than the depth of the inner socket walls. In one embodiment, the socket assembly also includes an inner cylindrical collar that extends up from the bottom of the inner socket. The cylindrical collar is concentric with the socket, and forms an annular pocket. The lower ends of each socket are disposed within the annular pocket to secure the lower ends in the inner socket while allowing each segment to pivot about its pivot edge. In one embodiment, a locking cap is used over the socket adjacent the upper ends of the segments to retain the segments in the inner socket. In one embodiment, the socket is sized to accept the plurality of individual floating segments for a fastener of a given size or given range of sizes. Therefore, the socket itself is larger than the desired fastener size, as the segments will effectively reduce the size of the socket. For example, for a 0.5 inch (1.25 cm) hex head bolt fastener having six sides, each having a width of about ⅜ inch to about 7/16 inch (0.95 cm to 1.1 cm), a 1 and ¼ inch six socket point socket is used.

In accordance with one exemplary embodiment, the present invention is directed to a socket assembly containing a plurality of multi-faceted segments. Each multi-faceted segment has a length extending between two ends and a plurality of flat facets extending along the length. In one embodiment, the plurality of multi-faceted segments is identical multi-faceted segments. In one embodiment, the plurality of multi-faceted segments includes six multi-faceted segments, and each multi-faceted segment has five flat facets. In one embodiment, the length is less than a depth an internal socket of the standard multi-pointed socket.

In one embodiment, the plurality of multi-faceted segments is positioned in an annular arrangement with all facets extending parallel to each other. Each multi-faceted segment has a first outer facet and a second outer facet facing outward from the annular arrangement. In one embodiment, the first outer facet and the second outer facet intersect at an angle of about 90°. Each multi-faceted segment includes a pivot edge defined between the first and second outer facets, extending along the length, and positioned to engage an apex between two internal socket walls of the standard multi-pointed socket. In one embodiment, the first outer facet has a first outer facet width, and the second outer facet has a second outer facet width. The first and second outer facet widths extend perpendicular to the length, and the first outer facet width is less than the second outer facet width. In one embodiment, each multi-faceted segment includes a pivot edge defined between the first and second outer facets. Each multi-faceted segment is position in the annular arrangement of the plurality of multi-faceted segments such that the first outer facet of that multi-faceted segment extends from the pivot edge in a desired direction of rotation of the standard multi-pointed socket with respect to the annular arrangement.

Each multi-faceted segment includes an inner facet facing inward from the annular arrangement. Each inner facet includes an inner facet width extending perpendicular to the length. The inner facet width is equal to a side of a multi-sided fastener to be gripped by the socket assembly. In one embodiment, each multi-faceted segment has a first side facet extending between the first outer facet and the inner facet and a second side facet extending between the second outer facet and the inner facet. The first side facet has a first side facet width, and the second side facet has a second side facet width. The first and second side facet widths extend perpendicular to the length, and the first side facet width is greater than the second side facet width. In one embodiment, the first side facet and the second side facet intersect the inner facet at an angle of about 90°.

In one embodiment, each multi-faceted segment has a pivot edge defined between the first and second outer facets and positioned to engage an apex between two inner socket walls of the standard multi-pointed socket. The first side facet and second side facet of adjacent multi-faceted segments in the annular arrangement do not contact each other when the adjacent multi-faceted segments pivot about the pivot edges. In one embodiment, the plurality of multi-faceted segments includes a separate multi-faceted segment for each apex between internal socket walls in the multi-pointed socket. In one embodiment, the plurality of multi-faceted segments are positioned in an annular arrangement with all facets extending parallel to each other, and the socket assembly includes an annular collar in the standard multi-pointed socket. The annular collar defines an annular pocket, and the annular arrangement is disposed on the annular pocket such that one end of each multi-faceted segment is disposed in the annular pocket and the annular collar extends partially along the length of each multi-faceted segment.

The socket assembly includes a retaining mechanism to secure the plurality of multi-faceted segments in a standard multi-point socket. In one embodiment, the retaining mechanism is a releasable retaining mechanism. Suitable retaining mechanisms include, but are not limited to, an adhesive, a mechanical fastener, a magnet, a biasing member, an annular locking cap centered over an open end of the standard multi-pointed socket, a notch and groove and combinations thereof.

In one exemplary embodiment, the present invention is directed to a socket assembly having a standard multi-point socket with an internal socket for accepting a multi-sided fastener. A plurality of multi-faceted segments is positioned in an annular arrangement with all facets extending parallel to each other and disposed in the internal socket. Each multi-faceted segment includes a length extending between two ends, a first outer facet and a second outer facet facing outward from the annular arrangement toward two adjacent internal socket walls of the internal socket and a pivot edge defined between the first and second outer facets, extending along the length, and positioned to engage an apex between the two adjacent internal socket walls. Each segment also includes an inner facet facing inward from the annular arrangement. The inner facet has a width equal to a side of the multi-sided fastener to be gripped by the socket assembly. A first side facet extends between the first outer facet and the inner facet, and a second side facet extends between the second outer facet and the inner facet. The first side facet and second side facet of adjacent multi-faceted segments in the annular arrangement do not contact each other when the adjacent multi-faceted segments pivot about the pivot edges. A retaining mechanism is provided to secure the plurality of multi-faceted segments in the standard multi-point socket.

DETAILED DESCRIPTION

Figure 1:
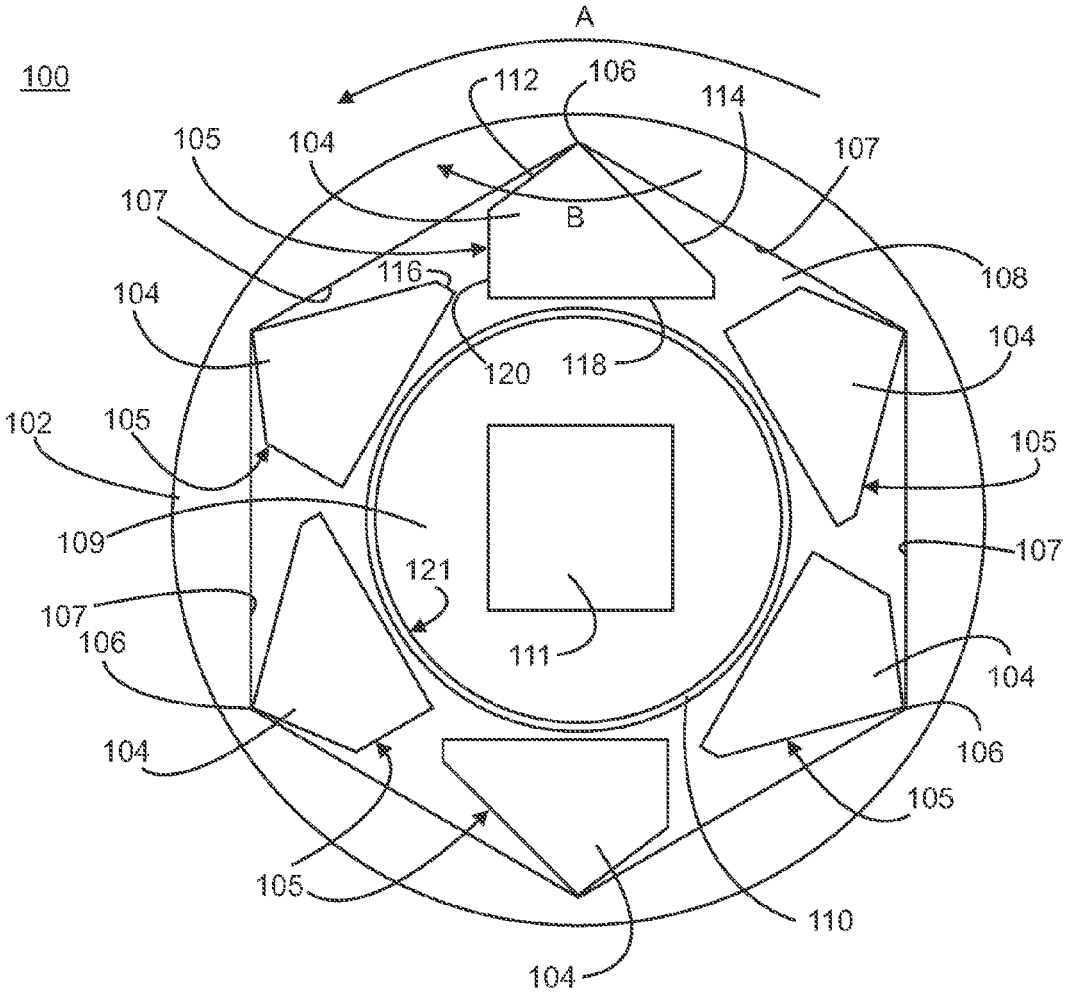
FIG. 1 is a top view of an embodiment of a socket assembly in accordance with the present invention.
Figure 2:
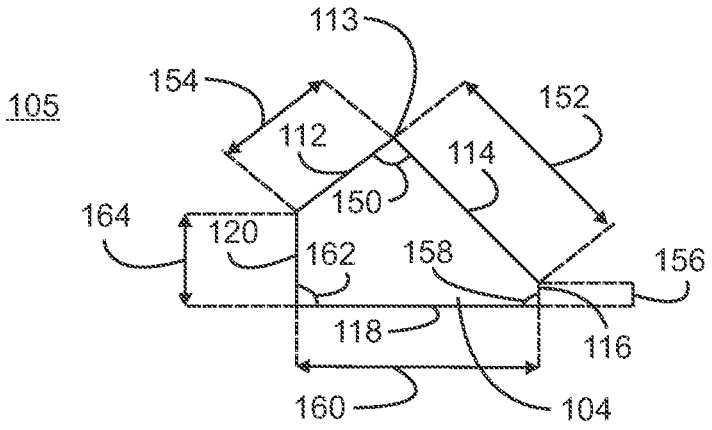
FIG. 2 is an end view of an embodiment of a multi-faceted segment for use in the socket assembly.
Figure 3:
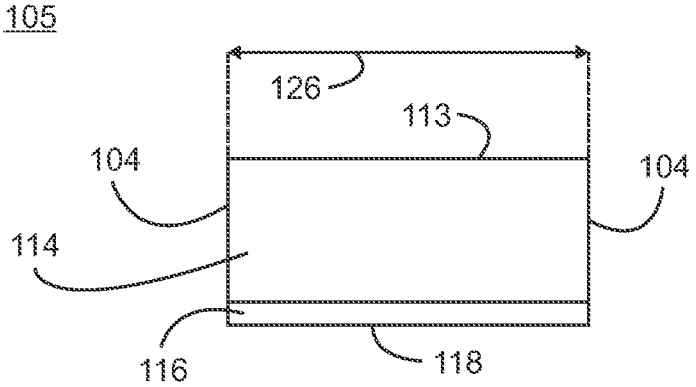
FIG. 3 is a side view along the length of an embodiment of a multi-faceted segment for use in the socket assembly.
Figure 4:
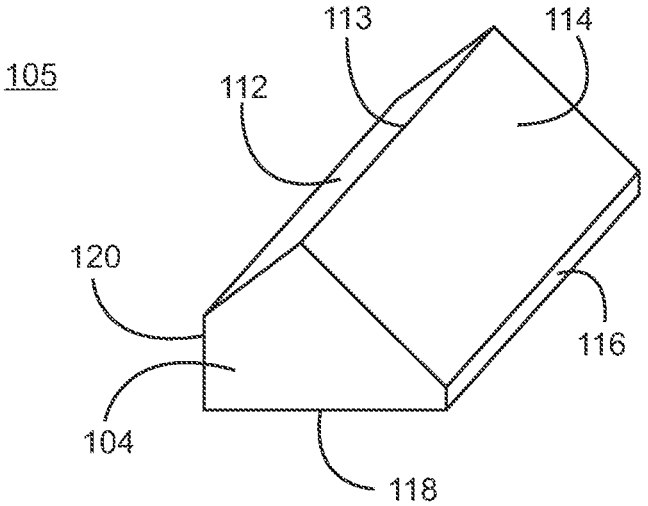
FIG. 4 is a perspective view from an outer facet side of an embodiment of a multi-faceted segment for use in the socket assembly.
Figure 5:
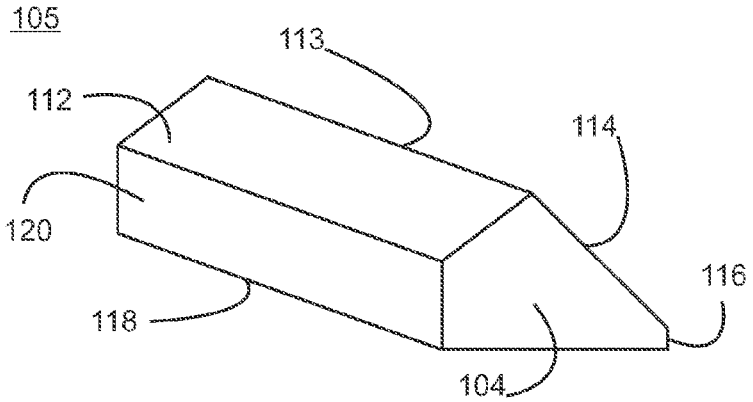
FIG. 5 is another perspective view from an outer facet side of an embodiment of a multi-faceted segment for use in the socket assembly.
Figure 6:
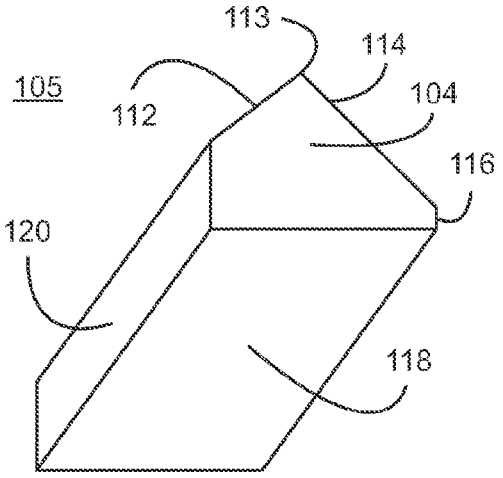
FIG. 6 is a perspective view from an inner facet side of an embodiment of a multi-faceted segment for use in the socket assembly.
Figure 7:
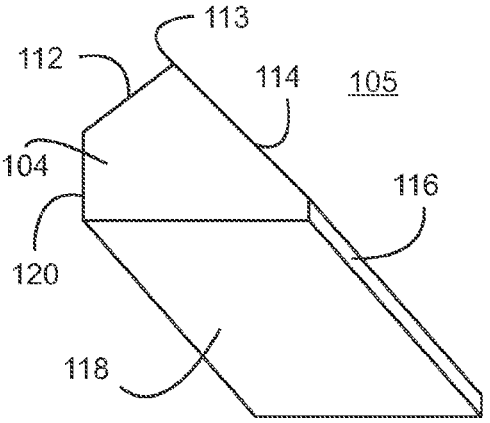
FIG. 7 is another perspective view from an inner facet side of an embodiment of a multi-faceted segment for use in the socket assembly.

Referring initially to FIG. 1, an exemplary embodiment of a socket assembly 100 in accordance with the present invention is illustrated. In one embodiment, the socket assembly includes a plurality of multi-faceted segments 105. Although each multi-faceted segment can have a unique number, size and arrangement of facets, preferably, the plurality of multi-faceted segments contains a plurality of identical multi-faceted segments. For example, the plurality of multi-faceted segments includes six multi-faceted segments, and each multi-faceted segment has five flat facets, i.e., each facet is contained within a given plane and does not contain a curvature running along the facet between any two edges of the facet. In one embodiment, the plurality of multi-faceted segments is positioned in an annular arrangement with all facets extending parallel to each other.

In one embodiment, the socket assembly 100 includes a standard multi-point socket 102. Any suitable socket known and available in the art can be used. The multi-point socket 102 includes an internal socket 109 that extends into the multi-point socket and includes a plurality of internal socket walls 107 that are arranged to accept a multi-sided fastener. Suitable multi-sided fasteners include nuts and bolts that have a plurality of sides separated by a plurality of edges. Such multi-sided fasteners are well known and available in the art and include fasteners constructed from metals and plastics as well as fasteners that are painted or coated, e.g., epoxy coated. The multi-sided fasteners and the corresponding multi-point socket can be sized in standard or metric sizes.

The internal socket also includes a plurality of apexes 106 disposed between adjacent internal socket walls and extending along the depth of the internal socket. Each apex is a corner or point of the multi-point socket. Suitable multi-point sockets have four points—square, six points—hexagon, eight points—octagon and 12 points—double hexagon or dodecagon. In one embodiment, the number of multi-faceted segments can equal the number of points or apexes in the internal socket, with each multi-faceted segment associated with one apex. Therefore, the plurality of multi-faceted segments includes a separate multi-faceted segment for each apex between internal socket walls in the multi-pointed socket. Alternatively, the number of multi-faceted segments is less than the number of points, for example six multi-faceted segments in a dodecagon multi-point socket with a multi-faceted segment associated with every other apex. The multi-pointed socket also includes a central bore 111, for example a square bore, for attachment to a wrench to rotate or drive the socket. Suitable arrangements of central bores and wrenches are known and available in the art.

In one embodiment, the socket assembly includes the multi-pointed socket, and the plurality of multi-faceted segments are fixedly or removably installed in the internal socket. Alternatively, the socket assembly does not include the multi-pointed socket itself, and the plurality of multi-faceted segments are arranged as an insert, for example, an annular insert or a plurality of individual segment inserts. This insert can then be placed into and removed from the desired existing multi-pointed socket.

Referring to FIGS. 2-7, in one embodiment, each multi-faceted segment 105 includes a length 126 extending between two opposite ends 104 of the segment. This length can be any length up to a length equal to a depth of the internal socket. Alternatively, the length is less than a depth an internal socket of the standard multi-pointed socket. In one embodiment, each segment has a longitudinal length that is approximately 0.03 inches less than the depth of the inner socket walls. Each one of the plurality of flat facets extends along this length. In one embodiment, the plurality of multi-faceted segments is positioned in an annular arrangement with all facets extending parallel to each other. Each multi-faceted segment comprises a first outer facet 112 and a second outer facet 114. When positioned in the annular arrangement, the first and second outer facets face outward from the annular arrangement. When this annular arrangement is placed in the multi-pointed socket, the first and second outer facets faced toward adjacent internal socket walls in the multi-pointed socket.

Each multi-faceted segment includes a pivot edge 113 defined between the first and second outer facets. This pivot edge extends along the length of the segment. When the segment is placed in the internal socket, the pivot edge is positioned to engage an apex between the two adjacent internal socket walls of the standard multi-pointed socket towards which the first and second outer facets face. The segment will pivot about this pivot edge within the apex; therefore, the angle 150 at the pivot edge between the first and second outer facets is less than the angle between the two internal socket facets on either side of the apex in which the pivot edge is engaged. In one embodiment, the first outer facet and the second outer facet intersect at an angle of about 90°.

Figure 10:
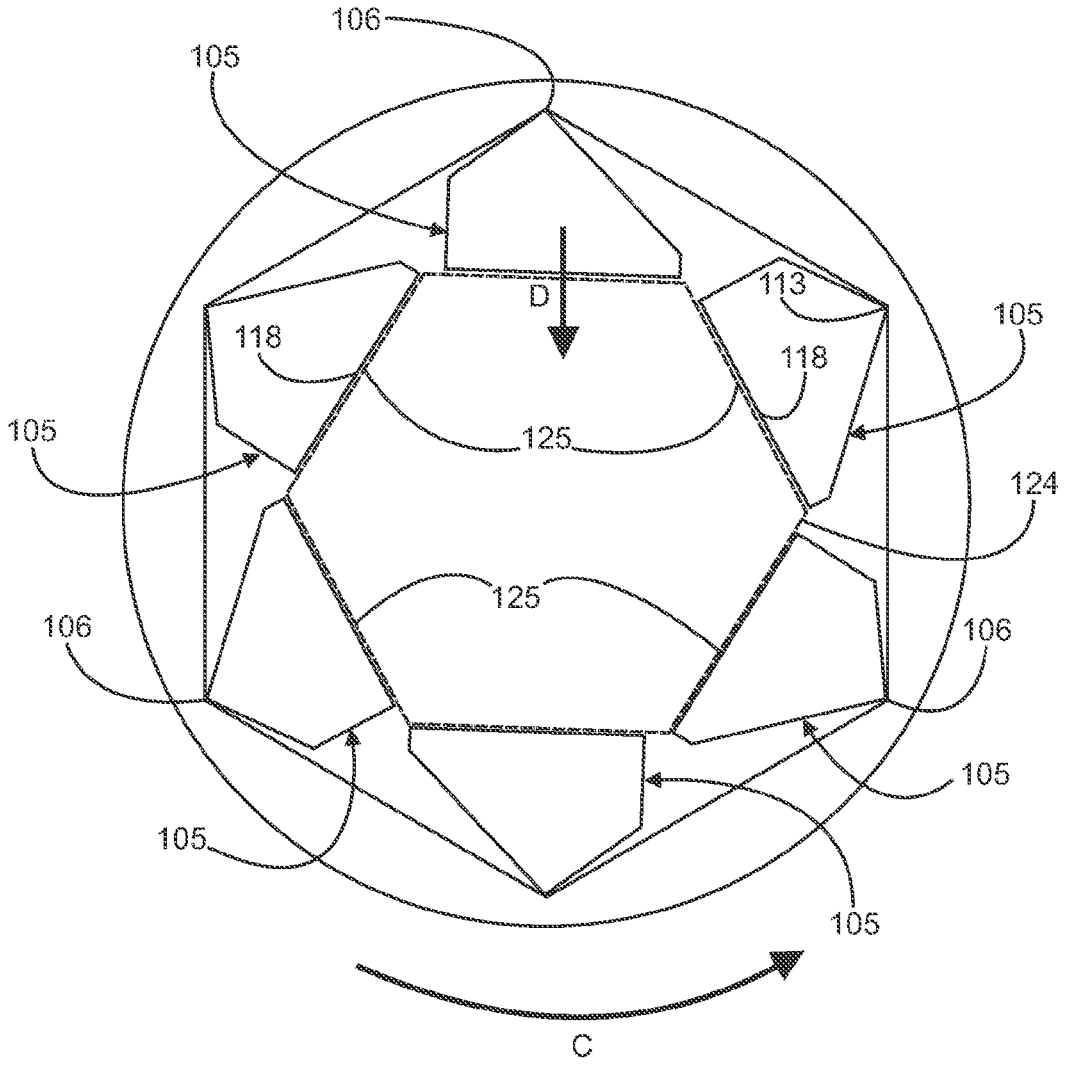
FIG. 10 is a top view of an embodiment of an annular arrangement of a plurality of multi-faceted segments disposed in a standard socket and engaging a multi-sided fastener.

The first outer facet has a first outer facet width 154, and the second outer facet has a second outer facet width 152. These first and second outer facet widths extend perpendicular to the length of the segment. In one embodiment, the first and second outer facet widths are equal. Alternatively, the first outer facet width is less than the second outer facet width. When each multi-faceted segment is positioned in the annular arrangement of the plurality of multi-faceted segments and placed in the internal socket, each segment is oriented such that the first outer facet 112 of that multi-faceted segment extends from the pivot edge in a desired direction of rotation of the standard multi-pointed socket with respect to the annular arrangement as indicated by arrow A. This will cause the segment to rotate about the pivot edge in a direction as indicated by arrow B, bringing the segment into a desired orientation with respect to the sides of the fastener (FIG. 10). Therefore, in one embodiment, the segments have an orientation based upon a desired direction of rotation, e.g., to tightened or loosen the fastener. Alternatively arrangements provide a first and a second outer face geometry so that a given segment orientation within the internal socket provides for rotation of the socket in both directions, i.e., for both tightening and loosening a fastener. When the socket assembly includes the annular arrangement of the plurality of segments, the socket assembly can be inserted into the internal socket in one of two opposite orientations as determined by which ends of the segments are inserted first. The orientation determines if the socket assembly can be used for tightening or loosening the fastener. Indicators on the socket assembly, including words, symbols and colors can be used to indicate the orientation required for tightening or loosening.

Continuing with FIGS. 2-7, each multi-faceted segment includes an inner facet 118. When the multi-faceted segments are positioned in the annular arrangement, these inner facets face inward. Therefore, these inner facets are arranged and positioned to contact the sides of the multi-sided fastener that is to be turned by the socket assembly. In one embodiment, each inner facet has an inner facet width 160 that extends perpendicular to the length 126. The inner facet width can be any length up to a length equal to the side of the multi-sided fastener. Preferably, the inner facet width is equal to the side of a multi-sided fastener to be gripped by the socket assembly. Therefore, each inner facet engages an entire side of the fastener, avoiding contact with the edges of the fastener and applying radial pressure along an entire side of the fastener. In one embodiment, the inner facet is flat and substantially free of barbs or other markings that could scratch the surface of the side of the fastener or otherwise remove coatings applied to the side of the fastener. A smooth inner facet can be achieved through processes including tumbling, polishing and sand blasting. The edge where the inner facet meets each end of the multi-faceted segment can be chamfered, beveled or otherwise sloped to guide insertion of a multi-sided fastener into the annular arrangement.

Each multi-faceted segment includes a first side facet 120 extending between the first outer facet and the inner facet and a second side facet 116 extending between the second outer facet and the inner facet. The first side facet has a first side facet width 164, and the second side facet has a second side facet width 156. The first and second side facet widths extend perpendicular to the length, and the first side facet width is greater than the second side facet width. In one embodiment, the first side facet intersects the inner facet at an angle 162 of about 90°, and the second side facet intersects the inner facet at an angle 158 of about 90°. Overall, each segment is sized for use with a given standard multi-pointed socket or range of multi-pointed sockets such that the first side facet and second side facet of adjacent multi-faceted segments in the annular arrangement do not contact each other when the adjacent multi-faceted segments pivot about the pivot edges. Therefore, each multi-faceted segment in the plurality of multi-faceted segments is free to rotate about its pivot edge in a given apex without contacting the other multi-faceted segments.

Figure 8:
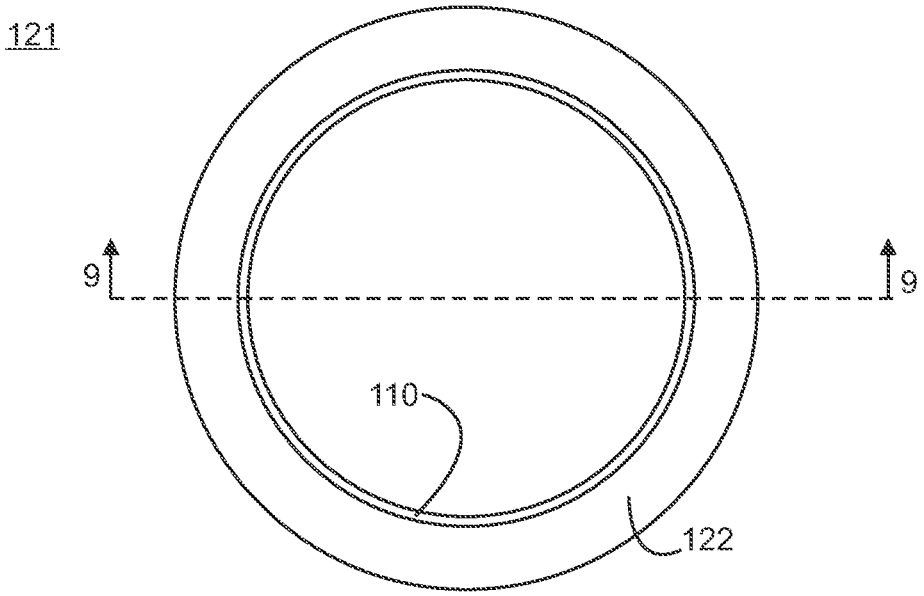
FIG. 8 is a top view of an embodiment of a retaining collar insert for use in the socket assembly.
Figure 9:
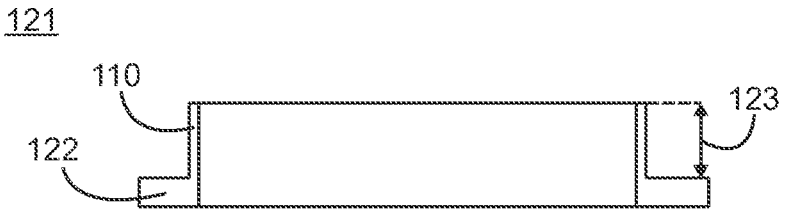
FIG. 9 is a view through line 9-9 of FIG. 8.

Referring to FIGS. 1, 8 and 9, the socket assembly includes an annular collar 110 in the standard multi-pointed socket. The annular collar defines an annular pocket 108. The annular arrangement is disposed in the annular pocket such that one end of each multi-faceted segment is disposed in the annular pocket and the annular collar extends partially along the length of each multi-faceted segment. In one embodiment, the annular collar is part of a ring-shaped internal socket insert 121 that includes the annular collar extending up from a base 122 that forms the bottom of the annular pocket 108 on which the ends of each multi-faceted segment rests. The annular collar extends up from the base a height 123 that corresponds to the amount that the annular collar extends partially along the length of each multi-faceted segment. The insert is sized and shaped to fit within in the internal socket.

Suitable materials for the various portions of the socket assembly include, but are not limited to, metals, for example, steel and stainless steel, plastics, carbon fiber, elastomers, magnetic materials and combinations thereof. For example, each multifaceted segment can be stamped from metal or cut from metal bar stock. Each multifaceted segment can be constructed from metal and have a polymer or elastomer covering on one or more facets. In one embodiment, each multifaceted segment is formed of carbon fiber and has metal located at bearing points or along the inner fact and the pivot edge. Each multifaceted segment can have magnetic material along the pivot edge or disposed on the first and second outer facets or the inner facet.

Referring to FIG. 10, when a multi-side fastener 124 is placed within the annular arrangement of the plurality of multi-faceted segments disposed in the internal socket of a standard multi-pointed socket and the socket is rotated in the desired direction as indicated by arrow C, each multi-facet segment pivots about its pivot edge 113 in a given apex 106. This brings each inner facet 118 into contact with a corresponding side 125 of the multi-sided fastener substantially along each entire side. Continued rotation of the socket in the desired rotational direction, translates this rotation into radial pressure in the direction of arrow D against each side and also rotates the multi-sided fastener in the desired direction. The radial pressure translates the rotational forces along the sides of the fastener, avoiding the application of force to the edges between the sides. The radial force also prevents sliding movement between the inner facets and the sides of the fastener.

Figure 11:
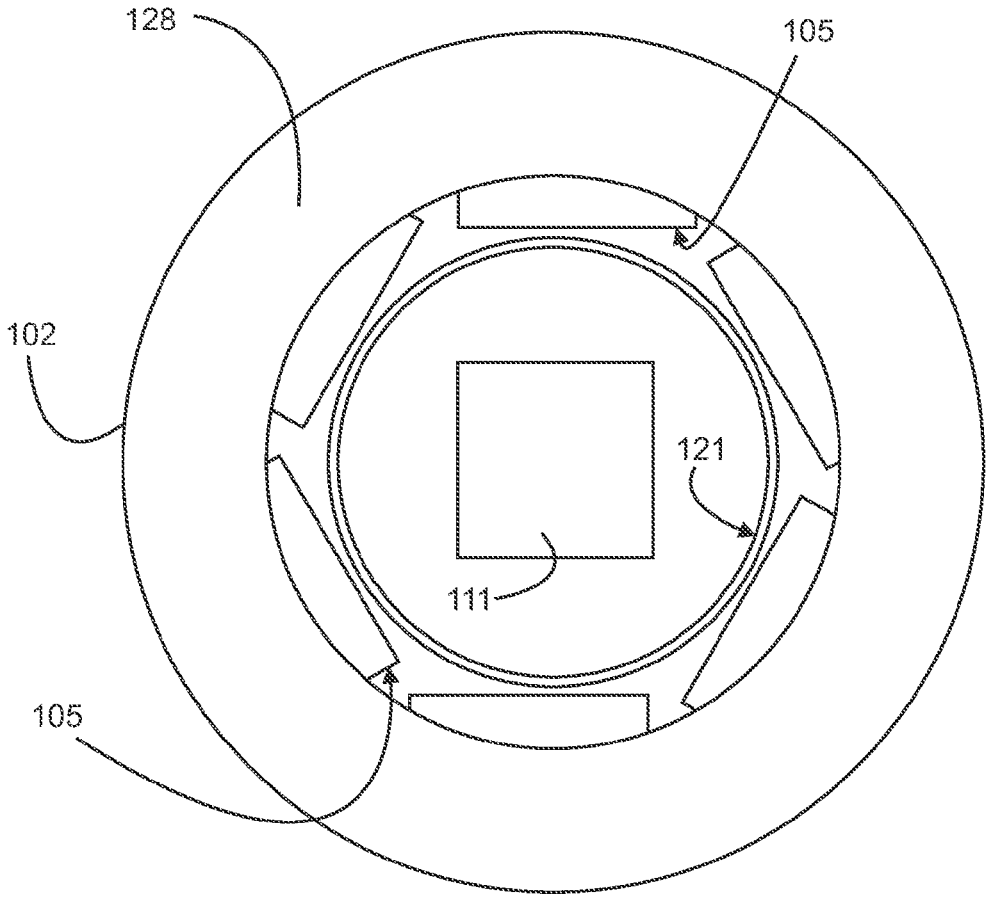
FIG. 11 is a top view of an embodiment of a socket assembly in accordance with the present invention with an embodiment of an annular locking cap.
Figure 12:
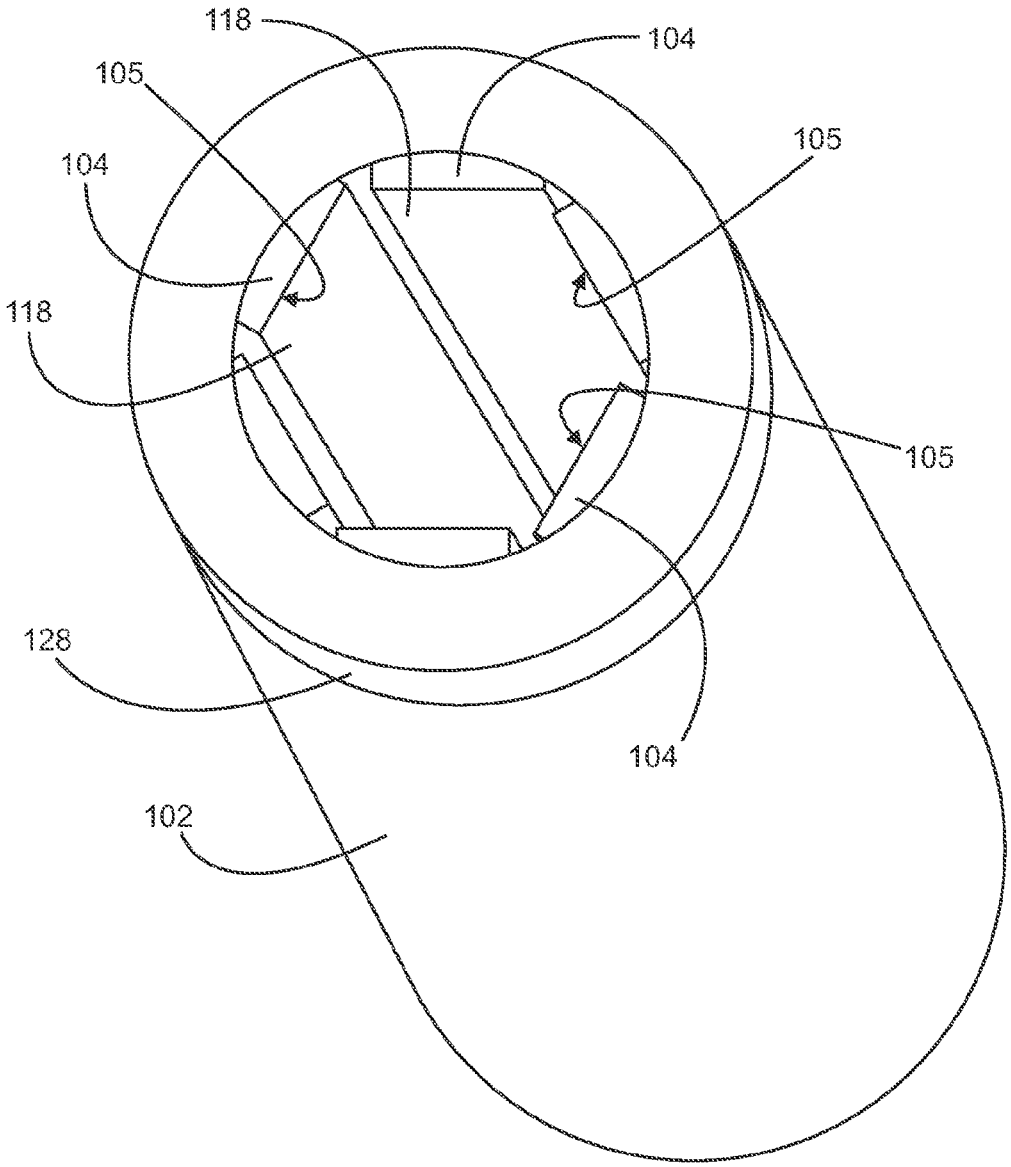
FIG. 12 is a perspective view from the top of the embodiment of FIG. 11.

In one embodiment, the socket assembly includes a retaining mechanism to secure the plurality of multi-faceted segments in a standard multi-point socket. This retaining or attachment mechanism can be a releasable attachment mechanism or an attachment mechanism that fixedly secures the multi-faceted segments in the internal socket. Suitable retaining or attachment mechanisms include, but are not limited to, an adhesive, a mechanical fastener, a magnet, a biasing member, an annular locking cap centered over an open end of the standard multi-pointed socket, a notch and groove and combinations thereof. Referring to FIGS. 11 and 12, in one embodiment, the attachment mechanism is an annular locking cap 128 that is centered over the open end of the internal socket. The annular locking cap includes a central circular opening to permit insertion of the fastener into the annular arrangement of the multi-faceted segments. Suitable methods for attaching the annular locking cap to the standard socket include adhesives, welds, screws, tangs and grooves and combinations thereof. The annular locking cap can be fixedly or removably attached to the standard socket.

Figure 13:
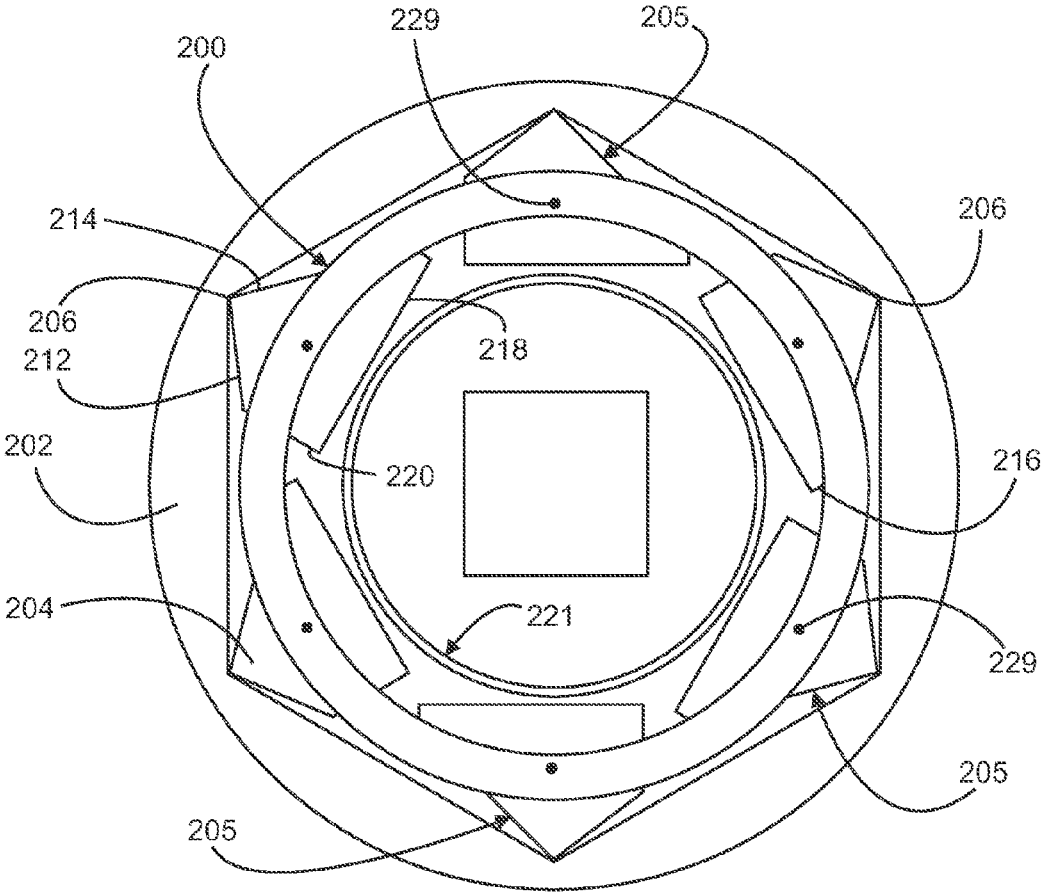
FIG. 13 is a top view of an insert embodiment of the socket assembly in accordance with the present invention disposed in a standard socket.
Figure 14:
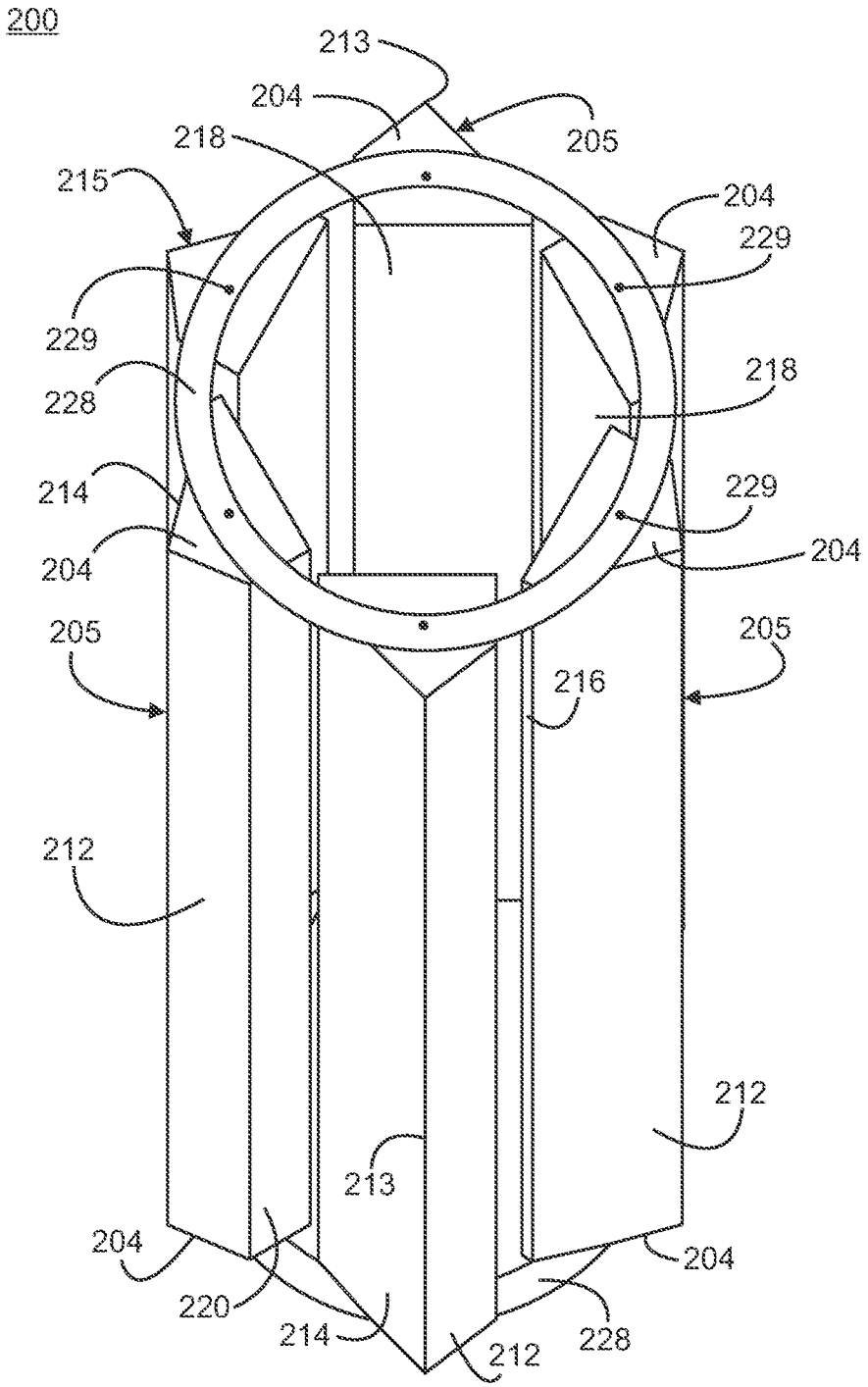
FIG. 14 is a top perspective view of the insert embodiment of the socket assembly.

Referring to FIGS. 13 and 14, in one embodiment, the socket assembly 200 is arranged as an insert that can be removably inserted into the internal socket of a standard multi-pointed socket 202 in one of two orientations for either tightening or loosening a multi-side fastener. The socket assembly 200 includes the plurality of multi-faceted segments 205. In one embodiment, the plurality of multi-faceted segments includes six multi-faceted segments, and each multi-faceted segment has five flat facets, i.e., each facet is contained within a given plane and does not contain a curvature running along the facet between any two edges of the facet. In one embodiment, the plurality of multi-faceted segments is positioned in an annular arrangement with all facets extending parallel to each other.

In one embodiment, the socket assembly 200 is placed in a standard multi-point socket 202 that includes a plurality of apexes 206 disposed between adjacent internal socket walls and extending along the depth of the internal socket. Each apex is a corner or point of the multi-point socket. Suitable multi-point sockets have four points—square, six points—hexagon, eight points—octagon and 12 points—double hexagon or dodecagon. In one embodiment, the number of multi-faceted segments can equal the number of points or apexes in the internal socket, with each multi-faceted segment associated with one apex. Therefore, the plurality of multi-faceted segments includes a separate multi-faceted segment for each apex between internal socket walls in the multi-pointed socket. Alternatively, the number of multi-faceted segments is less than the number of points, for example six multi-faceted segments in a dodecagon multi-point socket with a multi-faceted segment associated with every other apex. The multi-pointed socket also includes a central bore, for example a square bore, for attachment to a wrench to rotate or drive the socket. Suitable arrangements of central bores and wrenches are known and available in the art.

Each multi-faceted segment 205 includes a length extending between two opposite ends 204 of the segment. This length can be any length up to a length equal to a depth of the internal socket. Alternatively, the length is less than a depth an internal socket of the standard multi-pointed socket. In one embodiment, each segment has a longitudinal length that is approximately 0.03 inches less than the depth of the inner socket walls. Each one of the plurality of flat facets extends along this length. In one embodiment, the plurality of multi-faceted segments is positioned in an annular arrangement with all facets extending parallel to each other. Each multi-faceted segment comprises the first outer facet 212 and the second outer facet 214. When positioned in the annular arrangement, the first and second outer facets face outward from the annular arrangement. When this annular arrangement is placed in the multi-pointed socket, the first and second outer facets faced toward adjacent internal socket walls in the multi-pointed socket.

Each multi-faceted segment includes the pivot edge 213 defined between the first and second outer facets. This pivot edge extends along the length of the segment. When the segment is placed in the internal socket, the pivot edge is positioned to engage an apex between the two adjacent internal socket walls of the standard multi-pointed socket towards which the first and second outer facets face. The segment will pivot about this pivot edge within the apex; therefore, the angle at the pivot edge between the first and second outer facets is less than the angle between the two internal socket facets on either side of the apex in which the pivot edge is engaged. When the each multi-faceted segment is positioned in the annular arrangement of the plurality of multi-faceted segments and placed in the internal socket in the desired orientation, each segment is oriented such that the first outer facet 212 of that multi-faceted segment extends from the pivot edge in a desired direction of rotation of the standard multi-pointed socket with respect to the annular arrangement. Therefore, in one embodiment, the segments have an orientation based upon a desired direction of rotation, e.g., to tightened or loosen the fastener.

Each multi-faceted segment includes an inner facet 218. When the multi-faceted segments are positioned in the annular arrangement, these inner facets face inward. Therefore, these inner facets are arranged and positioned to contact the sides of the multi-sided fastener that is to be turned by the socket assembly. The inner facet width can be any length up to a length equal to the side of the multi-sided fastener. Preferably, the inner facet width is equal to the side of a multi-sided fastener to be gripped by the socket assembly. Therefore, each inner facet engages an entire side of the fastener, avoiding contact with the edges of the fastener and applying radial pressure along an entire side of the fastener. In one embodiment, the inner facet is flat and substantially free of barbs or other markings that could scratch the surface of the side of the fastener or otherwise remove coatings applied to the side of the fastener. A smooth inner facet can be achieved through processes including tumbling, polishing and sand blasting.

Each multi-faceted segment includes a first side facet 220 extending between the first outer facet and the inner facet and a second side facet 216 extending between the second outer facet and the inner facet. Overall, each segment is sized for use with a given standard multi-pointed socket or range of multi-pointed sockets such that the first side facet and second side facet of adjacent multi-faceted segments in the annular arrangement do not contact each other when the adjacent multi-faceted segments pivot about the pivot edges. Therefore, each multi-faceted segment in the plurality of multi-faceted segments is free to rotate about its pivot edge in a given apex without contacting the other multi-faceted segments. In one embodiment, the socket is sized to accept the plurality of individual floating segments for a fastener of a given size or given range of sizes. Therefore, the socket itself is larger than the desired fastener size, as the segments will effectively reduce the size of the socket. In one embodiment, the socket assembly fits into a conventional socket that is from about 1.25 to about 2.5 times larger than the size of the fastener to be gripped by the socket assembly. For example, the standard socket can be about 1.5, 1.75, 2 or 2.25 times large than the desired size of the fastener to be gripped by the socket assembly.

A retainer ring 228 is provided at a top and bottom of the annular arrangement and contacts the respective ends of all of the multi-faceted segments. A plurality of pins 229 are secured to each retainer ring and pass through each multi-faceted segment. The retainer rings and pins hold the multi-faceted segments together as an insert and form the socket assembly. Each multi-faceted segment can pivot around a given pin as necessary to provide the desired functionality to the socket assembly as described herein. In addition, a shaft may be formed in each multi-faceted segment through which a given pin passes, and this shaft may be elongated or oversized to provide additional degrees of freedom of movement of each multi-faceted segment, e.g., radially movement in an elongated slot, as desired for proper operation of the socket assembly. In one embodiment, insertion of the socket assembly with a given retainer ring on a given end of the socket assembly being inserted first into the internal socket will determine if the socket assembly is oriented to tighten or loosen a given fastener. Each retainer ring can include alphanumeric markings, colors or other markings to indicate the end to insert for the desired operational orientation. In one embodiment, each retainer ring is constructed form a magnetic material to secure the socket assembly in the standard socket.

In one embodiment, an annular collar 210 is provided in the standard multi-pointed socket to provide the annular pocket as described above.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A socket assembly comprising:

a multi-pointed socket comprising an internal socket for accepting a multi-sided fastener;

a plurality of multi-faceted segments, each multi-faceted segment comprising:

a length extending between two ends;

a plurality of flat facets extending along the length; and a pivot edge defined between two facets, extending along the length and positioned to engage an apex between two internal socket walls of the multi-pointed socket; and a retaining mechanism to secure the plurality of multi-faceted segments in the internal socket of the multi-pointed socket.

2. The socket assembly of claim 1, wherein the plurality of multi-faceted segments comprise a plurality of identical multi-faceted segments.

3. The socket assembly of claim 1, wherein:

the plurality of multi-faceted segments are positioned in an annular arrangement with the length of each segment aligned parallel to the length of every other segment; and the two facets in each multi-faceted segment comprise a first outer facet and a second outer facet facing outward from the annular arrangement.

4. The socket assembly of claim 3, wherein the first outer facet and the second outer facet intersect at an angle of about 90°.

5. The socket assembly of claim 3, wherein:

the first outer facet comprises a first outer facet width;

the second outer facet comprises a second outer facet width;

the first and second outer facet widths extending perpendicular to the length; and the first outer facet width less than the second outer facet width.

6. The socket assembly of claim 5, wherein:

each multi-faceted segment further comprises a pivot edge defined between the first and second outer facets; and each multi-faceted segment is position in the annular arrangement of the plurality of multi-faceted segments such that the first outer facet of that multi-faceted segment extends from the pivot edge in a desired direction of rotation of the multi-pointed socket with respect to the annular arrangement.

7. The socket assembly of claim 3, wherein each multi-faceted segment further comprises an inner facet facing inward from the annular arrangement.

8. The socket assembly of claim 7, wherein each inner facet comprises an inner facet width extending perpendicular to the length, the inner facet width equal to a side of a multi-sided fastener to be gripped by the socket assembly.

9. The socket assembly of claim 7, wherein each multi-faceted segment further comprises:

a first side facet extending between the first outer facet and the inner facet; and a second side facet extending between the second outer facet and the inner facet.

10. The socket assembly of claim 9, wherein:

the first side facet comprises a first side facet width;

the second side facet comprises a second side facet width;

the first and second side facet widths extending perpendicular to the length; and the first side facet width greater than the second side facet width.

11. The socket assembly of claim 9, wherein the first side facet and the second side facet intersect the inner facet at an angle of about 90°.

12. The socket assembly of claim 9, wherein:

each multi-faceted segment further comprises a pivot edge defined between the first and second outer facets and positioned to engage an apex between two inner socket walls of the multi-pointed socket; and the first side facet and second side facet of adjacent multi-faceted segments in the annular arrangement do not contact each other when the adjacent multi-faceted segments pivot about the pivot edges.

13. The socket assembly of claim 1, wherein the plurality of multi-faceted segments comprises a separate multi-faceted segment for each apex between internal socket walls in the multi-pointed socket.

14. The socket assembly of claim 1, wherein:

the plurality of multi-faceted segments comprises six multi-faceted segments; and each multi-faceted segment comprises five flat facets.

15. The socket assembly of claim 1, wherein the length is less than a depth an internal socket of the multi-pointed socket.

16. The socket assembly of claim 1, wherein:

the plurality of multi-faceted segments are positioned in an annular arrangement with the length of each segment aligned parallel to the length of every other segment;

the socket assembly further comprises an annular collar in the multi-pointed socket, the annular collar defining an annular pocket; and the annular arrangement is disposed on the annular pocket such that one end of each multi-faceted segment is disposed in the annular pocket and the annular collar extends partially along the length of each multi-faceted segment.

17. The socket assembly of claim 1, wherein the retaining mechanism comprises a releasable attachment mechanism.

18. The socket assembly of claim 1, wherein the retaining mechanism comprises an adhesive, a mechanical fastener, a magnet, a biasing member, an annular locking cap centered over an open end of the multi-pointed socket, a notch and groove or combinations thereof.

19. A socket assembly comprising:

a multi-pointed socket comprising an internal socket for accepting a multi-sided fastener;

a plurality of multi-faceted segments positioned in an annular arrangement and disposed in the internal socket, each multi-faceted segment comprising:

a length extending between two ends;

a first outer facet and a second outer facet facing outward from the annular arrangement toward two adjacent internal socket walls of the internal socket;

a pivot edge defined between the first and second outer facets, extending along the length, and positioned to engage an apex between the two adjacent internal socket walls;

an inner facet facing inward from the annular arrangement, the inner facet comprising a width equal to a side of the multi-sided fastener to be gripped by the socket assembly;

a first side facet extending between the first outer facet and the inner facet; and a second side facet extending between the second outer facet and the inner facet, wherein the first side facet and second side facet of adjacent multi-faceted segments in the annular arrangement do not contact each other when the adjacent multi-faceted segments pivot about the pivot edges and the length of each segment is aligned parallel to the length of every other segment; and a retaining mechanism to secure the plurality of multi-faceted segments in the standard multi-pointed socket.

20. A socket assembly comprising:

a plurality of multi-faceted segments, each multi-faceted segment comprising a length extending between two ends, a plurality of flat facets extending along the length and a pivot edge defined between two facets that extends along the length; and a retainer to hold the plurality of multi-faceted segments together in an annular arrangement and to form the socket assembly;

wherein the socket assembly is configured as an annular insert for an internal socket of a multi-pointed socket such that each pivot edge engages an apex between two internal socket walls of the multi-pointed socket.

* * * * *